United States Patent [19]

Brooker

[11] Patent Number: 4,897,922

[45] Date of Patent: Feb. 6, 1990

[54] FOLDING KNIFE

[75] Inventor: Dennis B. Brooker, Derby, Iowa

[73] Assignee: Ventura Forge, Inc., Ventura, Calif.

[21] Appl. No.: 381,751

[22] Filed: Jul. 17, 1989

[51] Int. Cl.[4] ..... B26B 3/06

[52] U.S. Cl. ..... 30/166; 30/155

[58] Field of Search ..... 30/155, 160, 161, 337

[56] References Cited

U.S. PATENT DOCUMENTS

| | | | |
|---|---|---|---|
| 729,378 | 5/1903 | Mintzer | 30/161 X |
| 1,454,665 | 5/1923 | Bobek | 30/161 |
| 2,728,984 | 1/1956 | Hopta | 30/161 |
| 4,669,188 | 6/1987 | Evrell | 30/161 |

*Primary Examiner*—Douglas D. Watts

*Attorney, Agent, or Firm*—Henderson & Sturm

[57] ABSTRACT

A folding knife apparatus has an elongated handle with a slot formed therein. A knife blade has a working edge and an edge opposite to the working edge also has an abutment portion on one end of the opposite edge. The blade has a storage position wherein the working edge is disposed in the slot and a working position thereof approximately 180 degrees from the storage position thereof wherein the working edge extends out of the slot. The knife blade is pivotally attached to the handle along a first axis for permitting movement of the blade between the storage and working positions thereof. A lock member is rotatably attached to the handle along a second axis and has a locked position and an unlocked position. The lock member is in engagement with the abutment portion of the opposite edge of the blade when the blade is in the working position and the lock member is in the locked position thereof. The lock member is spaced from the blade abutment portion when the lock member is in the unlocked position thereof.

9 Claims, 2 Drawing Sheets

FOLDING KNIFE

TECHNICAL FIELD

The present invention relates generally to knives and more particularly to folding knives.

BACKGROUND ART

Knives are, of course, one of the oldest and well known tools. Knives of the folding type typically include a blade pivoted directly to the handle. Springs, locks and mechanisms of all kinds have been attached to such basic structure. The problems, in general, with such mechanisms has been that such mechanisms tend to fail eventually, they are complicated to produce, the knives so produced are not strong or secure and thereby are prone to breakage and they are expensive to manufacture.

A traditional lock back knife uses an elongated leaf spring to hold the blade in a locked position. Pushing on one end of the leaf spring releases the blade to allow it to pivot. Wear between the leaf spring and the blade will eventually cause the blade to be loose in the locked position thereof.

Consequently, there is a need for a folding knife which is economical to mass produce, dependable to use and one which is not susceptible to looseness despite wear on the locked parts.

DISCLOSURE OF THE INVENTION

The present invention relates to a folding knife apparatus having an elongated handle with a slot formed therein. A knife blade having a working edge and an edge opposite to the working edge also has an abutment portion on one end of the opposite edge. The blade has a storage position wherein the working edge is disposed in the slot and a working position thereof approximately 180 degrees from the storage position thereof wherein the working edge extends out of the slot. The knife blade is pivotally attached to the handle along a first axis for permitting movement of the blade between the storage and working positions thereof. A lock member is rotatably attached to the handle along a second axis and has a locked position and a unlocked position. The lock member is in engagement with the abutment portion of the opposite edge of the blade when the blade is in the working position and the lock member is in the locked position thereof. The lock member is spaced from the blade abutment portion when the lock member is in the unlocked position thereof.

An object of the present invention is to provide an improved folding knife.

Another object of the present invention is to provide a folding knife which eliminates the use of springs, a part which falls.

A further object of the invention is to provide a folding knife which can be locked securely even if it is used so much that there is wear where the locking mechanism and the blade make contact.

A still further object of the invention is to provide a folding knife which is economical and simple to manufacture and dependable to use.

Other objects, and advantages, and novel features of the present invention will become apparent from the following detailed description of the invention when considered in conjunction with the accompanying drawings.

BEST MODE FOR CARRYING OUT THE INVENTION

Figure 1:
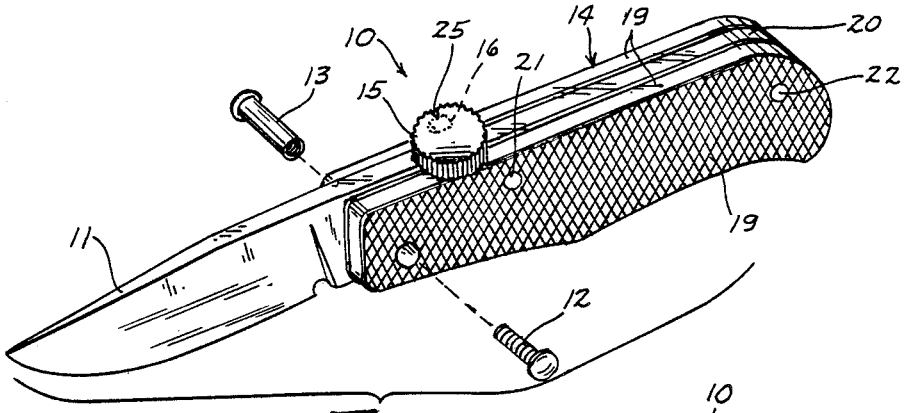
FIG. 1 is a perspective view of one embodiment of the present invention shown with the fastener that pivots the blade to the handle exploded.
Figure 2:
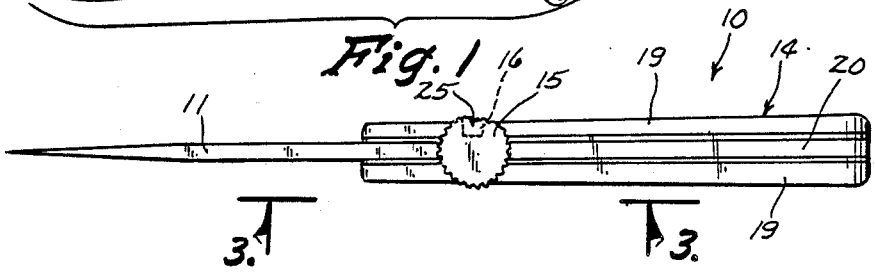
FIG. 2 is a top view of the knife of the present invention shown in an open and locked position.
Figure 3:
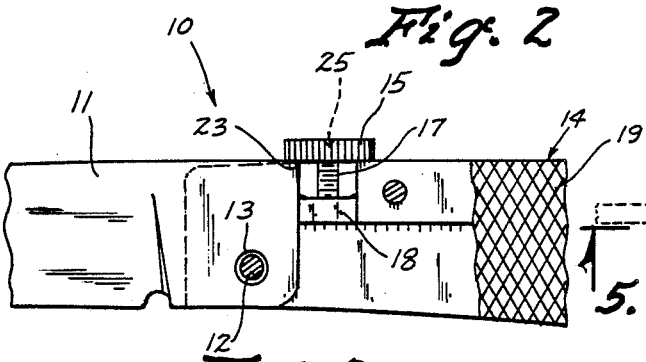
FIG. 3 is an enlarged partial view taken along line 3—3 of FIG. 2 with a portion of the handle removed to shown the interior workings thereof.
Figure 4:
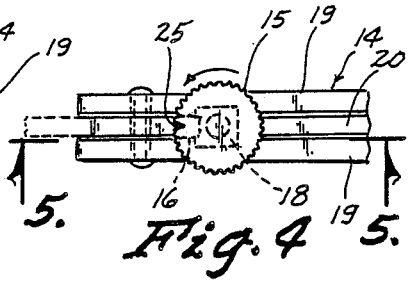
FIG. 4 is an enlarged partial top view of the present invention showing the locking mechanism in the unlocked position thereof with the blade folded to the storage position and the blade shown in dashed lines in a work position.

Referring now to the drawings wherein like reference numerals designate identical or corresponding parts throughout the several views, FIG. 1 shows a folding knife (10) having a blade (11) pivotally attached by fastener parts (12) and (13) to a handle (14). A locking mechanism (15) has a groove (16) on a portion of the underside thereof and this locking member (15) is rigidly attached to a threaded shaft (17) which threadably engages a square bolt (18), the square bolt (18) being welded to or otherwise permanently affixed to the knife handle (14).

The knife handle (14) has two side handle portions (19) and a central rigid metal member (20) with all three of the handle portions, including the two portions (19) and the central portion (20), rigidly connected together by rivets (21) and (22). FIG. 1 shows the blade (11) in the locked position with the locking member (15) rotated so that the notch (16) is not disposed above the abutment portion (23) of the knife blade (11) and also having the bottom planar surface of the lock member (15) tightly screwed down against the abutment portion (23) of the blade (11) to hold it securely in the locked position as shown in FIG. 1.

Figure 5:
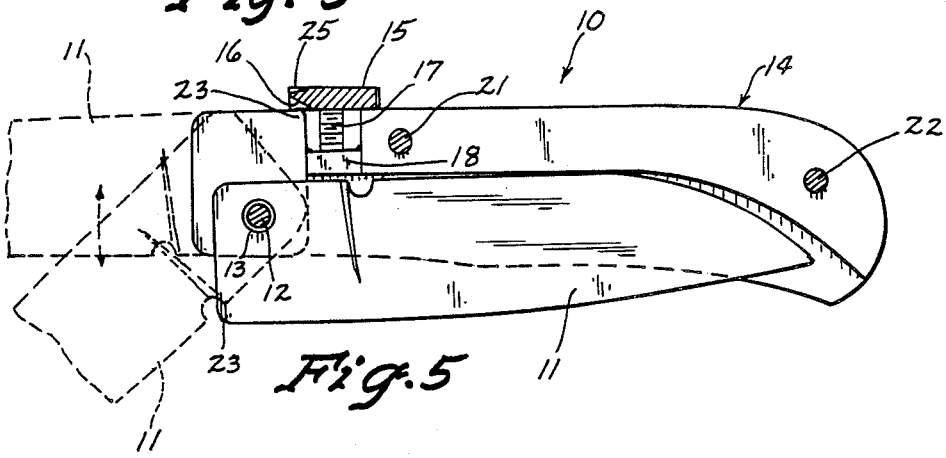
FIG. 5 is a cross-sectional view taken along line 5—5 of FIG. 4 and showing the blade pivoted to the storage position in solid lines and pivoted to a working position and to a position intermediate the working position in dashed lines.
Figure 6:
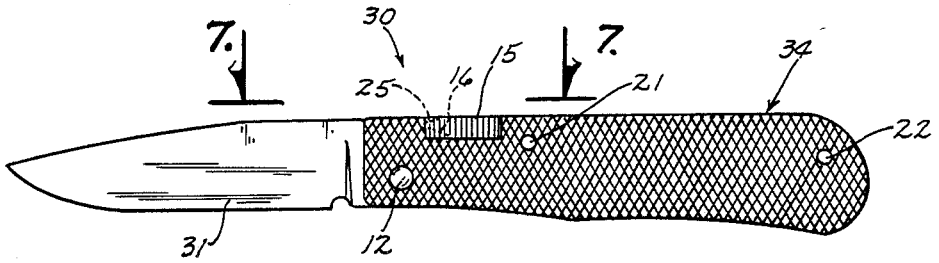
FIG. 6 is a side elevational view of another embodiment of the present invention showing the locking mechanism recessed into the handle.

When it is desired to unlock the blade (11) so that it can be folded to the storage position shown in solid lines in FIG. 5, the lock member (15) is rotated so that the lock member (15) moves upwardly while at the same time the groove (16) is aligned over the top of the abutment portion (23) of the blade (11) as shown in FIG. 5. Then the blade (11) can be pivoted from the position shown in dashed lines in FIG. 5 to the position shown in solid lines in FIG. 5.

Of course when it is desired to use the knife again, the blade (11) is pivoted from the position shown in solid lines in FIG. 5 to the position shown in dashed lines in FIG. 5 while the notch (16) is also in the same position shown in FIG. 5 and once the knife blade is moved to the position in solid lines in FIG. 1, then the lock member (15) is rotated to move downwardly at the same time that the notch (16) moves so that it is not disposed over the abutment portion (23), thereby having the planar bottom portion of the lock member (15) securely hold the blade (11) in locked position.

It will be understood to those skilled in this art, that even if some wear occurs on the abutment portion (23) or on the underside of the member (15), this wear will not cause the blade (11) to be loose in the locked position because all that the user needs to do is merely turn the lock member (15) a little more in a clockwise position and the lock member (15) will move down further against the abutment portion (23) to compensate for any such wear.

Referring now to FIGS. 6–9, it is noted that a second embodiment (30) is essentially identical to the embodiment (10) referred to above except that the lock member (15) is recessed into the handle (34) and the knife blade (31) has a notch (32) forming an abutment portion (33) which is recessed also downwardly to correspond to the position of the lock member (15). Otherwise, the knife (30) is identical to the knife apparatus (10) shown in FIGS. 1–5.

Figure 7:
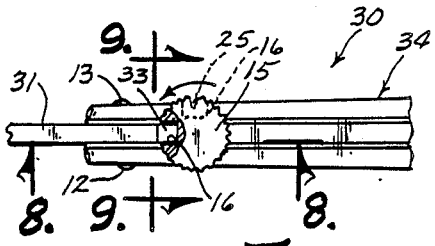
FIG. 7 is a partial view taken along line 7—7 and showing the blade in the working position but showing a portion of the lock member broken away in the unlocked position so that it can be folded to the storage position.
Figure 8:
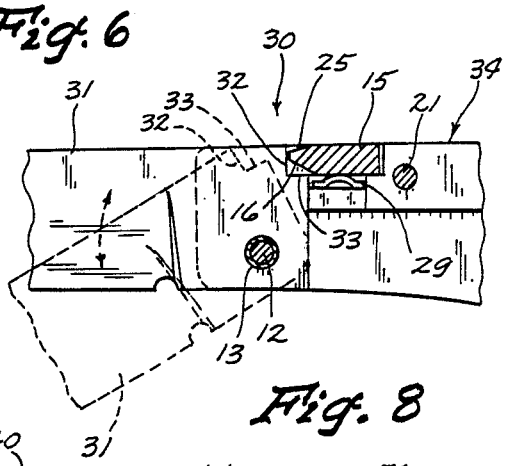
FIG. 8 is an enlarged partial cross-sectional view taken along line 8—8 of FIG. 7 and showing the blade in solid lines in the working position and the locking mechanism in the unlocked position and also showing in dashed lines how the blade can be pivoted from the working position towards a storage position when the lock member is in the unlocked position shown in FIG. 8.
Figure 9:
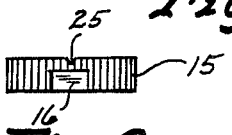
FIG. 9 is a cross-sectional view taken along line 9—9 of FIG. 7.
Figure 10:
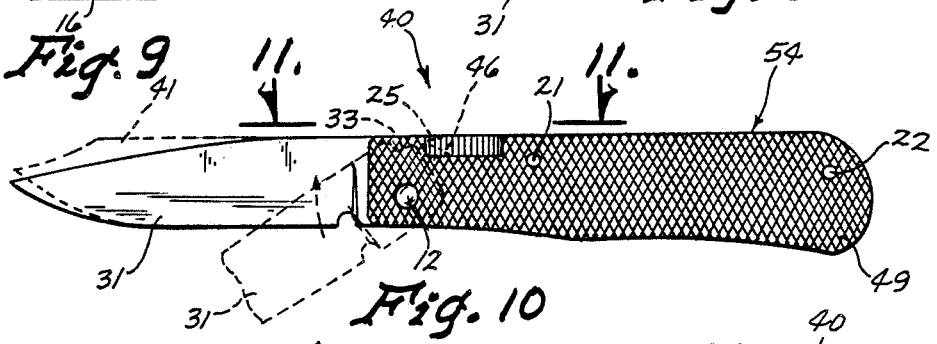
FIG. 10 is a side elevational view of still another preferred embodiment of the present invention showing a two-bladed version of the present invention.

FIGS. 7 and 8 show the notch (16) in an unlocked position and the blade (31) is shown in a working position in solid lines in FIG. 8, but FIG. 8 also shows how the blade (31) can be pivoted toward the storage position when the notch (16) of the lock member (15) is in the position shown in FIG. 8. Obviously, if it is desired to lock the blade (31) in the position shown in FIGS. 6 and 8, the lock member (15) needs to be rotated clockwise as shown from the top so as to cause the lock member (15) to be forced downwardly against the abutment portion (33), while at the same time the notch (16) is moved so that it is not disposed above the abutment portion (33) of the blade (31). Spring washer (29) holds lock member (15) from freely turning when it is in the position shown in FIG. 8.

Figure 11:
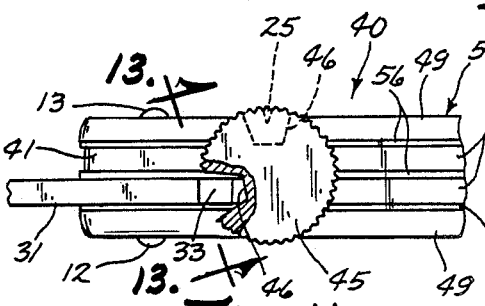
FIG. 11 is a view taken along line 11—11 of FIG. 10 and showing the front most blade of FIG. 10 unlocked by the lock member and showing the back most blade of FIG. 10 folded to the storage position thereof.

Referring now to FIGS. 10–13, it is noted that a two-bladed knife (40) is shown. Blades (31) and (41) are pivotally attached by the fasteners (12) and (13) and each of the blades (31) and (41) have notches like those shown for blade (31) in FIG. 8. The locking member (45) is like the locking member (15) of the previous embodiments except that it has a pie-shaped segment (46) removed instead of the segment shaped like (16). This segment or notch (46) is shown in FIG. 11 having the blade (31) in the working position and the locking member (45) rotated to an unlocked position for the blade (31), so that in the position shown in FIG. 11, the blade (31) can be pivoted to the storage position. Alternatively, in the position shown in FIG. 11, the locking member (45) can be rotated in a counterclockwise position to cause the underneath planar portion of the locking member (45) to firmly and tightly engage the abutment portion (33) of the blade (31) while at the same time the cut-out segment (46) will be moved to the position shown in dashed lines in FIG. 11 to prevent the blade (31) from becoming unlocked until it is desired to unlock it. Also, in FIG. 11 it is noted that the blade (41) is shown folded to the storage position thereof.

Figure 12:
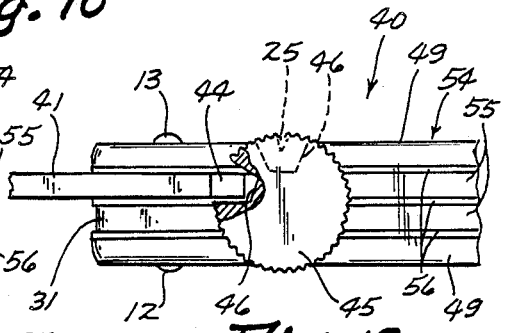
FIG. 12 shows the rear blade of FIG. 10 in a working position and the lock member shows it locking the front blade but unlocking the rear blade just prior to locking the rear blade into the locked and working position or, alternatively, just prior to pivoting the rear blade to the storage position.
Figure 13:
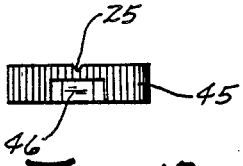
FIG. 13 is a cross-sectional view taken along line 13—13 of FIG. 11.

FIG. 12 shows the blade (31) moved to the storage position, for example, by folding it from the position shown in solid lines in FIG. 11 to the position shown in solid lines in FIG. 12 while the locking member (45) is in the position shown in FIG. 11. Then the locking member (45) can be rotated to the position shown in FIG. 12 thereby allowing the blade (41) to be pivoted from the sotrage position shown in FIG. 11 to the working position shown in FIG. 12. After that is done, the locking member (45) can be rotated in a clockwise position as shown in FIG. 12 to move the groove (46) from the position shown where it is disposed over the abutment portion (44) to the position shown where it is not over the abutment portion (44) whereby the blade (41) will be locked to the position shown in FIG. 12 while the same time the blade (31) will be in the storage position.

It is also noted that the handle (54) of the knife (40) has side members (49) and interior portions (55) with spacers (56) disposed therebetween. These are all connected together by rivets (21) and (22) just as in embodiments (10) and (30).

Idicia notches (25) on locking members (15) and (45) lie just above the centerline of the unlocking notches (16) and (46), respectively, so the user can tell where the notches (16) and (46) are positioned during use.

Accordingly, it will be appreciated that the preferred embodiments disclosed herein do indeed accomplish the aforementioned objects. Obviously many modifications and variations of the present invention are possible in light of the above teachings. It is therefore to be understood that, within the scope of the appended claims, the invention may be practiced otherwise than as specifically described.

I claim:

1. A folding knife apparatus comprising:

an elongated handle having a slot formed therein; opposite to said working edge, said opposite edge having an abutment portion on one end thereof, said blade having a storage position wherein said working edge is disposed in said slot and a working position thereof approximately 180 degrees from said storage position thereof wherein said working edge extends out of said slot;

means for pivotally attaching one end of said knife blade to said handle along a first axis for permitting movement of said blade between the storage and working positions thereof;

a lock member, said lock member having a locked position and a unlocked position;

means for rotatably attaching said lock member to said handle along a second axis between said locked and unlocked positions thereof;

said lock member being in engagement with said abutment portion of said opposite edge of the blade when said blade is in said working position and said lock member is in the locked position thereof; and said lock member being spaced from said blade abutment portion when the lock member is in the unlocked position thereof.

2. The folding knife apparatus of claim 1 wherein said attaching means further comprises means for threadably attaching said lock member to said handle whereby said lock member moves toward said handle when said lock member is rotated in one rotary direction and said lock member moves away from said handle means when said lock member is rotated in the other rotary direction.

3. The folding knife apparatus of claim 1 wherein said lock member is generally circular in shape with a segment of the lower exterior periphery thereof being removed.

4. The folding knife apparatus of claim 3 wherein said lock member is disposed on top of said handle.

5. The folding knife apparatus of claim 1 wherein said lock member is generally disc-shaped with a segment of the lower outer underside being removed.

6. The folding knife apparatus of claim 5 wherein said lock member is recessed into a recess in the top of the handle.

7. The folding knife apparatus of claim 6 wherein said opposite edge of said one end of the blade having said abutment portion thereon also having a notch disposed therein.

8. The folding knife apparatus of claim 1 including a second elongated knife blade pivotally attached to said handle along said first axis for permitting movement of said second blade between storage and working positions thereof; and means associated with said lock member for permitting said lock member to lock either of the blades in the working position thereof while permitting the other of said blades to be in the unlocked position.

9. The folding knife apparatus of claim 1 wherein said locking member is generally disc-shaped with a knurled exterior periphery.

* * * * *